US005684264A

United States Patent [19]

Cassells et al.

[11] Patent Number: 5,684,264

[45] Date of Patent: Nov. 4, 1997

[54] BALLISTIC CONTAINMENT DEVICE

[76] Inventors: James R. Cassells, 53 Tromley Drive, Islington, Ontario, Canada, M9B 5Y7; Gary J. Isberg, 131 Admiral Road, Toronto, Ontario, Canada, M5R 2L7

[21] Appl. No.: 548,918

[22] Filed: Oct. 26, 1995

[51] Int. Cl.[6] ..... F41H 11/06

[52] U.S. Cl. ..... 89/1.1; 428/911; 220/468; 220/453; 220/DIG. 21

[58] Field of Search ..... 89/36.02, 36.07, 89/1.1, 1.11; 273/410, 403; 220/453, 464, DIG. 21, 468; 428/911

[56] References Cited

U.S. PATENT DOCUMENTS

| | | | |
|---|---|---|---|
| 1,010,514 | 12/1911 | Mount | 89/36.02 |
| 3,268,107 | 8/1966 | Sperling | 220/DIG. 21 |
| 3,786,956 | 1/1974 | Tabor | 220/DIG. 21 |
| 4,201,385 | 5/1980 | Szabados | 273/102.4 |
| 4,299,639 | 11/1981 | Bayer | 156/104 |
| 4,445,693 | 5/1984 | Angwin | 273/404 |
| 4,787,289 | 11/1988 | Duer | 89/36.02 |
| 4,846,043 | 7/1989 | Langsam | 89/1.1 |
| 4,889,258 | 12/1989 | Yerushalmi | 220/429 |
| 5,354,605 | 10/1994 | Lin et al. | 428/263 |
| 5,366,105 | 11/1994 | Kerman et al. | 220/453 |
| 5,440,965 | 8/1995 | Cordova et al. | 89/36.02 |
| 5,536,553 | 7/1996 | Coppage, Jr. et al. | 428/102 |

*Primary Examiner*—Michael J. Carone
*Assistant Examiner*—Christopher K. Montgomery
*Attorney, Agent, or Firm*—Patrick J. Hofbauer

[57] ABSTRACT

A ballistic containment device for use in inspecting, loading and unloading firearms having an outer drum with a rim portion defining an open end, an inner wall surface and a closed end, together forming an outer chamber into which is suspended a semi-rigid kinetic energy absorptive member, which member is constructed from a plurality of layers of fabric woven from long chain synthetic polyamide fibre, which layers are bonded to one another by a non-rigid adhesive material. The kinetic energy absorptive member is suspended into the catchment member, from the rim portion as aforesaid, by means of a support web constructed of a plurality of overlapping straps of fabric woven from long chain synthetic polyamide fibre bonded to the kinetic energy absorptive member by means of the non-rigid adhesive material.

21 Claims, 4 Drawing Sheets

BALLISTIC CONTAINMENT DEVICE

FIELD OF THE INVENTION

The present invention relates to a ballistic containment device for containing bullets which may be accidentally discharged during the inspecting, loading and unloading of firearms.

BACKGROUND OF THE INVENTION

One of the most significant risks for individuals who regularly use firearms, such as law enforcement officers, occurs during the inspecting, loading and unloading thereof. Although firearms safety procedures are stressed to law enforcement officers, there will always be occasions when, despite ordinary caution, accidental weapons discharges will occur, with potentially disastrous results. Most frequently such accidental discharge occurs during inspection, loading, and unloading of firearms.

The majority of safety devices in the firearms field have taken the form of armour barriers, sand pits, wall structures, or personal body armour. Bullet traps have also been developed to catch bullets in an undamaged condition for use in ballistics testing and forensic investigation applications; however such devices have not been practical for use as general safety devices during loading or unloading of firearms. Most of the known bullet traps ordinarily require precise positioning of the muzzle of the firearm, a condition which, by definition, will not be met in the context of the accidental discharge of a firearm during loading or unloading.

A box-type ballistic containment device, the subject of U.S. Pat. No. 5,366,105, which issued on Nov. 22, 1994 to Edward H. Kerman and Robert R. Crovatto, can be used to contain accidental discharges during firearms inspection, loading and unloading. The use of this device requires that the muzzle of the firearm be placed against an elastomeric curtain and directed into the box-shaped containment device. The inner walls of the device are lined with multiple layers having different characteristics (i.e. an elastomeric layer, a ballistic shield and a kinetic energy absorbing layer). The overall box-shape of the device dictates that a firearm must be rather carefully positioned in order to ensure optimal projectile stopping characteristics. Furthermore, the device is not readily adjustable to varying heights and weapons angles. Accordingly, not all personnel may be able to adopt a regulation safety stance for loading and unloading since, for certain individuals the proper stance may not permit access to the device. Moreover, given the shape of the patented device, unless the muzzle of the firearm is positioned at the proper angle while contacting the elastomeric curtain, projectiles may not be directed toward the most effectively shielded panel of the device, being the back panel. Additionally, the use of a curtain may have the effect of "blinding" the user to the optimal positioning of the muzzle, since the user is aiming at a curtain, which may obscure the user's view of the panels inside the device. Ideally, one ought to aim at the position in the device where optimal ballistic effect will be had.

While other prior devices are known for ballistic containment, they are not entirely satisfactory. Ideally, devices for this purpose must be relatively compact, easy to adjust to a user's height and relatively inexpensive to install and repair. It is possible to repair the device of U.S. Pat. No. 5,366,105 after discharging a firearm therein by replacing individual wall panels of the device; however, at least partial disassembly of the device by trained personnel would be necessary in order to access and remove a particular damaged panel.

It is an object of the present invention to provide a ballistic containment device for inspecting, loading and unloading firearms which overcomes the deficiencies associated with known containment devices.

More particularly, it is an object of the present invention to provide a ballistic containment device which safely and effectively contains projectiles discharged from firearms and prevents ricochets thereof back toward the user.

It is a further object of the present invention to provide a ballistic containment device which, by nature of its shape and structure, redirects the path of incoming projectiles to the portion of the device which most effectively contains the projectiles.

It is yet another object of the present invention to achieve optimal ballistic containment and ricochet prevention without the use of numerous different functional layers, or panels, each such layer or panel necessitating the use of differing materials having differing structural characteristics, all of which add to the cost and difficulty of repair of the device.

It is a further object of the present invention to provide a ballistic containment device which is completely adjustable over a wide variety of heights and angles to ensure that all personnel are able to adopt a regulation safety stance with respect to the device when loading or unloading firearms using the device.

It is yet a further object of the present invention to provide a ballistic containment device which is simple and inexpensive to repair after repeated use, requiring only the replacement of a single unitary structural component.

SUMMARY OF THE INVENTION

In accordance with the present invention there is disclosed a ballistic containment device for use in inspection, loading and unloading firearms, which device comprises an outer drum having a rim portion defining an open end; an inner wall surface axially extending from the rim portion to a closed end, with the rim portion, the inner wall surface, and the closed end defining an outer chamber. A semi-rigid kinetic energy absorptive member is suspended into the outer chamber from the rim portion. The kinetic energy absorptive member is constructed from a plurality of layers of fabric woven from an long chain synthetic polyamide fibre such as Kevlar®, said layers being bonded one to the other by means of a non-rigid adhesive material. The kinetic energy absorptive member is suspended into the catchment member, from the rim portion as aforesaid, by means of a support web constructed of a plurality of overlapping straps of fabric woven from long chain synthetic polyamide fibre bonded to the kinetic energy absorptive member by means of the non-rigid adhesive material.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

FIG. 3 of the drawings is a cross-sectional view of the encircled area "B" of FIG. 2, enlarged to show greater detail;

FIG. 7 of the drawings is a cross-sectional view of the encircled area "A" of FIG. 2, enlarged to show greater detail.

DETAILED DESCRIPTION OF A PREFERRED EMBODIMENT

Figure 1:
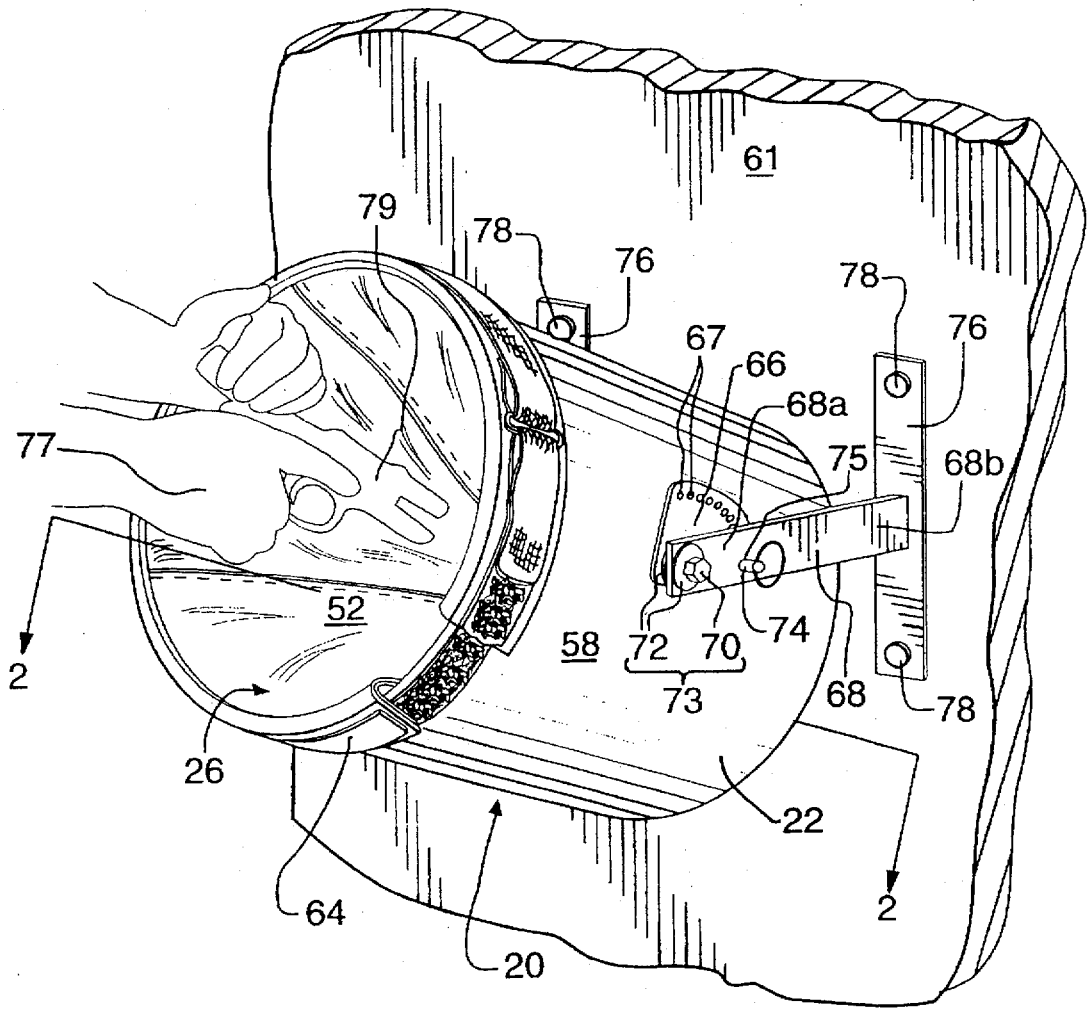
FIG. 1 of the drawings is a diagrammatic perspective view of a ballistic containment device according to a preferred embodiment of the invention shown in use mounted on a wall.

Referring now to FIG. 1 of the drawings, a ballistic containment device for inspecting, loading and unloading firearms according to a preferred embodiment of the invention is indicated by the general reference numeral 20. An outer drum 22 serves as a housing for the ballistic containment device 20, defining its overall outer shape. Additionally, the outer drum 22 serves to ultimately retain any bullets which may penetrate through the functional ballistic layers, as uncommon as this might be, as discussed more fully below. The outer drum 22 should be composed of a material which provides rigidity and strength, yet which is relatively lightweight to ensure that the ballistic containment device 20 is easily installable and adjustable. In the preferred embodiment the outer drum 22 is constructed from mild steel, and is generally cylindrical in shape.

The ballistic containment device 20 is further fitted with a means for mounting to either a horizontal or a vertical generally planar surface. It is preferred to mount the ballistic containment device 20 to a vertical surface, such as a wall 61, as seen in FIG. 1. The ballistic containment device is supported upon two support arms 68, attached to the outer surface 58 of the outer drum 22 at two diametrically opposed positions by two mounting studs 73. The support arms 68 may be conventionally secured at their respective base plates 76 to the wall 61. The ballistic containment device 20 is then pivotal about the longitudinal axis of the respective mounting studs 73 for tilt-angle adjustment, and can be secured in the desired operative position as discussed more fully below.

As illustrated in FIGS. 1–4, the outer drum 22 has a rim portion 24 defining an open end 26. An inner wall surface 28 extends axially from the rim portion 26 to a closed end 30. The rim portion 24, the inner wall surface 28, and the closed end 30 of outer drum 22 together define an outer chamber 32.

A semi-rigid kinetic energy absorptive member 34 is suspended into the outer chamber 32 from the rim portion 24. The semi-rigid kinetic energy absorptive member 34 draws its operative functional characteristics from the materials used in its construction. Additional detail of the structure of the semi-rigid kinetic energy absorptive member 34 can be seen in the encircled area "A" of FIG. 2 and in FIG. 7, as described more fully below.

The use of puncture resistant man made fabrics has been known in the field of ballistics and light-weight body armour for some time. It is important that such fabrics be capable of slowing and stopping projectiles such as bullets or shrapnel. One particularly effective type of fabric is woven from a long chain synthetic polyamide fibre and is available from Du Pont de Nemours E. I. and Co., of Wilmington, Del., U.S.A., (hereinafter "Du Pont"), under Dupont's registered trade mark Kevlar®. Du Pont makes available long chain synthetic polyamide fibre in the form of roving and yarns. Such fibres are then woven into many different weaves of Kevlar® fabric.

In the preferred embodiment of the present invention illustrated, 840 Denier 2×2 basket weave Kevlar® fabric is preferably used. Although this fabric is preferred, other grades of ballistic fabric woven from Kevlar® fibres may be used effectively in the manufacture of the kinetic energy absorptive member 34. The kinetic energy absorptive member 34 is constructed from a plurality of layers 34' of this ballistic fabric, each layer preferably formed from a plurality of petal-shaped panels thereof. The kinetic energy absorptive member should have between about 15 to 20 layers of petal-shaped panels, each layer preferably being comprised of two overlapping petal-shaped members **34*a* and 34*b*. For simplicity of illustration, nine layers 34'** of such panels, have been shown in FIG. 3.

The thickness of the kinetic energy absorptive member 34 may vary, depending upon the number of layers 34' of woven ballistic fabric which are applied during the manufacturing process. The resultant variation can be utilized to create a variety of ballistic containment devices having ballistic containment characteristics which vary in a readily predictable manner with the intended power of firearm which is to be most frequently used therewith. Ballistic tests by applicant have shown that a kinetic energy absorptive member 34 having a cross-sectional thickness of approximately ¼"to ½" (along the side walls thereof) will provide an optimal embodiment for the containment of most ballistic projectiles and with conventional hand guns. Such thickness can be routinely varied to suit the individual application needs as will be readily apparent to those skilled in the art.

Figure 4:
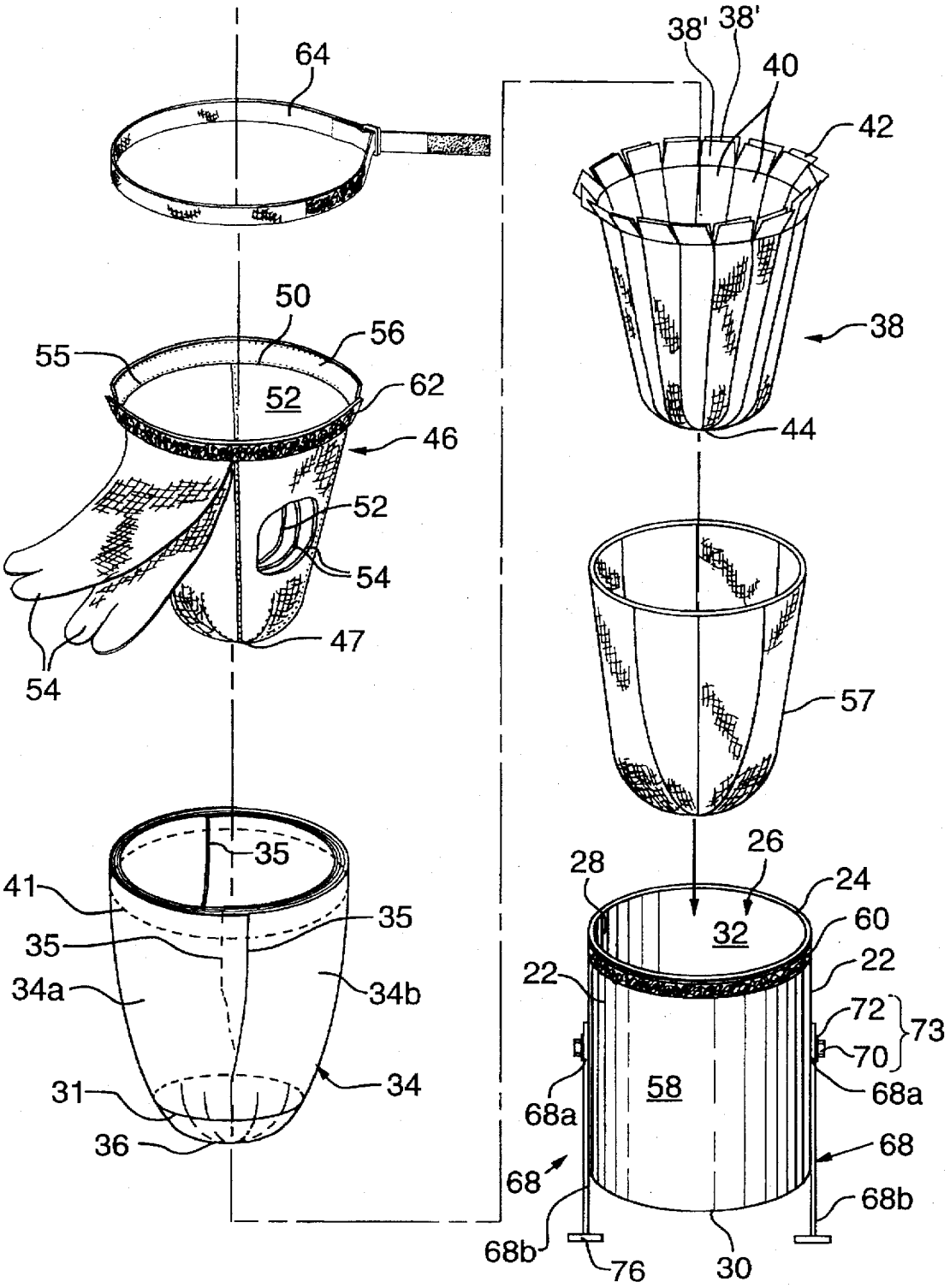
FIG. 4 of the drawings is an exploded perspective view of the ballistic containment device of FIGS. 1–3, shown detached from the wall with the base thereof oriented horizontally.

It has been found that a kinetic energy absorptive member 34 having a parabolic cross-section is an optimal shape for the containment of projectiles within the applicant device. The parabolic shape serves to funnel projectiles toward the tapered closed end 36 of the kinetic energy absorptive member 34, which tapered end is somewhat thickened due to the presence of additional substantially circular panels 31 of the ballistic fabric. FIG. 7, (showing the encircled area "A" of FIG. 2), presents enlarged detail of the substantially circular panels 31 inter-leaved between the layers 34' of the kinetic energy absorptive member 34. Additionally, the substantially circular panels 31 are shown in FIG. 4, in phantom outline, underneath the outer layer of petal shaped panels **34*a* and 34*b* in the kinetic energy absorptive member 34. Thus, greater kinetic energy absorption will occur at the thickened tapered closed end 36 of the kinetic energy absorptive member 34**.

The kinetic energy absorptive member 34, in its finished state, will be somewhat deformable when manual pressure is applied thereto, since neither the layers of ballistic fabric nor the adhesive material is completely rigid. Additionally, air pockets may be formed between individual layers of ballistic fabric, during manufacture. It is critical that the adhesive used in the kinetic energy absorptive member 34 maintain its flexibility even after it has been applied to the ballistic fabric. Resins which become brittle upon drying, such as polyester or epoxy resins used in the construction of Kevlar® canoes or other rigid objects, are not suitable, as their brittleness could result in shattering upon impact by a ballistic projectile. An example of an acceptable adhesive material is conventional butyl rubber-based contact cement. A preferred adhesive material is a hexane and cyclohexane solvent based styrene butadiene rubber adhesive available from, for example, 3M Co. of St. Paul, Minn.

The non-rigidity of the kinetic energy absorptive member 34 is a key factor in its effectiveness for ballistic projectile containment. When a projectile impacts upon the kinetic energy absorptive member 34, the layers of ballistic fabric will move and bodily yield in advance of the impinging projectile. This would not be readily possible if a rigid resin were employed between the layers of ballistic fabric. This movement allows for the absorption of kinetic energy, with the result that the projectile is decelerated by the kinetic energy absorptive member 34, and either becomes embedded therein, or may contact the kinetic energy absorptive member 34,and rebound therefrom with significantly less kinetic energy than prior to the initial collision therewith. Such rebounding projectile is contained by the anti-ricochet safety liner 46, as more fully described below. Only in the rarest instance, with extremely high-powered projectiles, would the possibility remain of such projectiles penetrating through the entire kinetic energy absorptive member 34. In the event that such a through-passing did occur, the projectile would then be caught in the outer drum 22.

Figure 2:
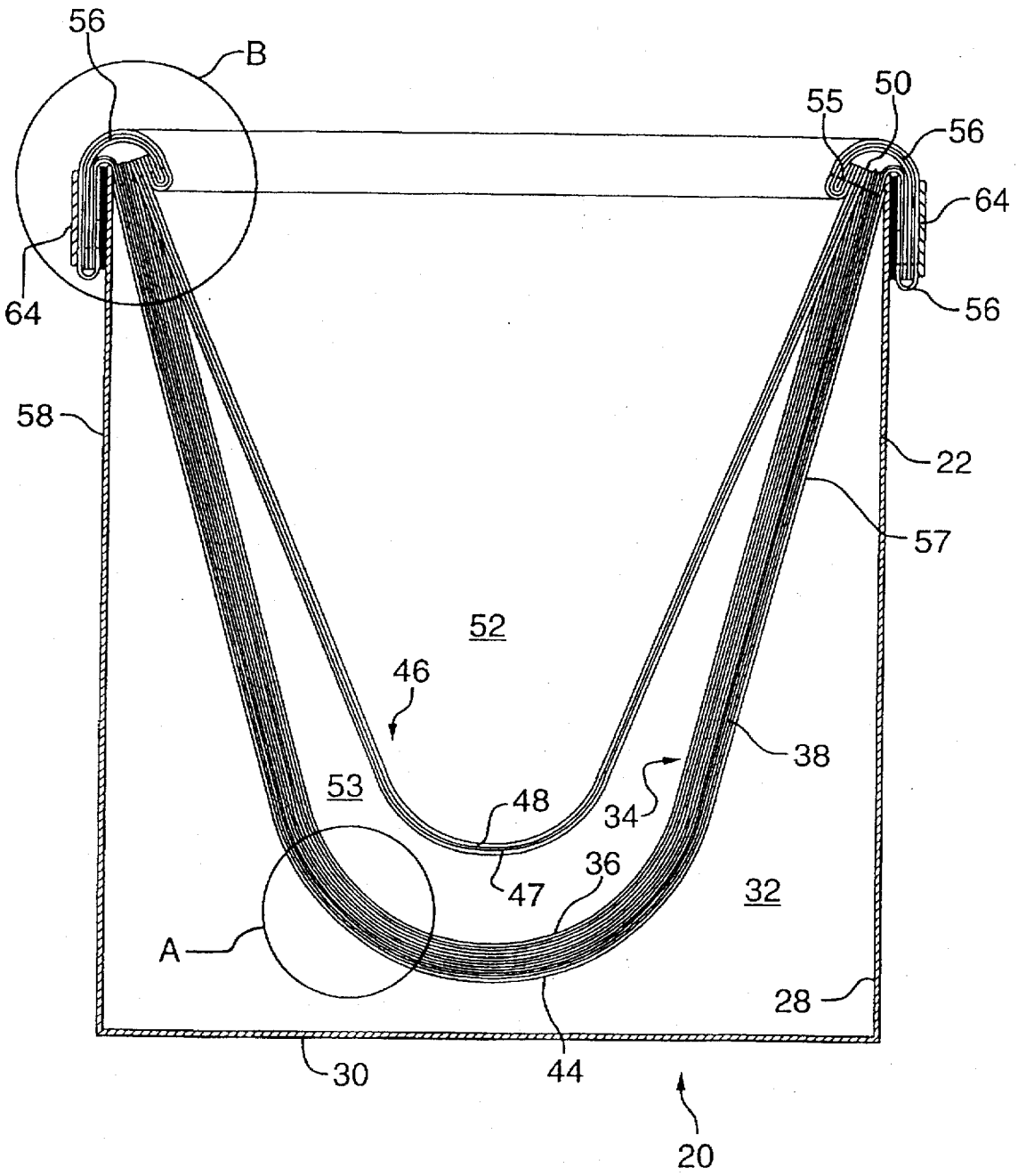
FIG. 2 of the drawings is a cross-sectional view of the device of FIG. 1 along sight line 2—2 of FIG. 1.

Referring now to FIGS. 2, 3, and 4, the kinetic energy absorptive member 34 is suspended into the outer chamber 32 from the rim portion 24 by means of a support web 38. The support web 38 is constructed from a plurality of substantially rectangular straps 40 of ballistic fabric material which are overlain each other to form a web of substantially parabolic cross-section. The support web 38 is affixed to the kinetic energy absorptive member 34 by non-rigid adhesive material. The free ends 42 of each of the straps 40 extend outwardly from the point of origin 44 of the parabolic cross-sectional shape of support web 38, so as to be attachable in overlying relation to rim portion 24 of outer drum 22. The support web 38 preferably comprises two discrete overlying layers 38',38' (see FIGS. 3 and 4), each being comprised of a separate plurality of said rectangular straps 40. The support web 38 is brought into close supporting contact with the energy absorptive member 34 upon assembly and need not be, but may, be adhered to the energy absorptive member 34.

The ballistic containment device 20 additionally comprises a multi-layered anti-ricochet safety liner, designated by the general reference numeral 46. The anti-ricochet safety liner 46 has a tapered closed end 47 at the parabolic point of origin thereof, and a distal perimeter portion 50.

The anti-ricochet safety liner 46 has an outer protective layer 52 and two kinetic energy absorptive sub-layers 54, 54. The outer protective layer 52 is constructed of a strong flexible textile material, which outer protective layer 52 serves a dual function. First, this layer functions as an initial barrier to an incoming projectile. A small amount of kinetic energy may be absorbed by this layer as the projectile passes therethrough. The second, and most critical, function of the outer protective layer 52 is to shield the inner surfaces of the ballistic containment device from ultraviolet light. The Kevlar® fibre material from which the ballistic fabric is composed is subject to degradation upon prolonged contact with ultraviolet light, and such degradation reduces, over time, the flexibility, strength, and thus, the integrity of the Kevlar® materials. Any lightweight, strong, yet flexible textile material, so long as it does not allow ultra violet light to pass therethrough, could be used to construct the outer protective layer 52 of the anti-ricochet safety liner 46. The preferred material for constructing the outer protective layer has been found to be a rough woven nylon fabric which is routinely available from Dupont, supra, under the registered trademark Cordura®. The Cordura® nylon fabric possesses all of the above-noted desirable features for constructing the outer protective layer 52, and additionally is relatively inexpensive, and can be obtained in a water resistant form.

The kinetic energy absorptive sub-layer 54 is also constructed from a ballistic fabric, such as Kevlar®. In the preferred embodiment shown, the kinetic energy absorptive sub-layer 54 is two-ply. Both of the sub-layers 54 and 54 are attached to one another, and to the outer protective layer 52, at their respective distal perimeter portions, by conventional stitching 55.

The anti-ricochet liner 46 is flexible and is suspended, in a manner, more fully described below, substantially out of contact with the kinetic energy absorptive member 34. A designed air chamber 53 is, thus, created between kinetic energy absorptive member 34 and anti-ricochet safety liner 46 (See FIG. 2). Further, the anti-ricochet safety liner 46 is free to move in response to an impinging projectile, absorbing kinetic energy from the projectile. Frequently, the ballistic projectile will pierce the kinetic energy absorptive sub-layer 54 of anti-ricochet safety liner 46, but following through-passing penetration thereof, the kinetic energy of the projectile is somewhat decreased. The projectile then encounters the kinetic energy absorptive member 34, and collision therewith results in the absorbtion of most, if not all, of the kinetic energy of the projectile. The projectile ultimately remains either lodged in kinetic energy absorptive member 34 or resting thereon. Alternatively, some projectiles will ricochet back toward the open end 26 of the outer drum 22; however, typically such projectile will, at this point in its trajectory, have lost sufficient kinetic energy that it cannot re-pierce the ballistic fabric of the kinetic energy absorptive sub-layer 54 of the anti-ricochet liner 46. Accordingly, the projectile will remain within the designed airspace 53, and will come to rest upon the kinetic energy absorptive member 34.

In the preferred embodiment of the ballistic containment device 20 illustrated, the free ends 42 of the straps of ballistic fabric 40 which comprise support web 38 are stitched to the distal perimeter 50 of anti-ricochet safety liner 46 by means of conventional stitching 55 (See FIGS. 3 and 4). As shown in detail in FIG. 3, the stitched joint edges are circumscribed by and secured to a tri-layer coupling strap 56, 56, 56 to form a unitary structure designated in FIG. 3 by general reference numeral 59, comprising the anti-ricochet safety liner 46, the kinetic energy absorptive member 34, the support web 38, and the coupling strap 56. A fabric covering 57, such as a polyester knit fabric is preferably attached, by non-rigid adhesive as previously disclosed, to the outside of the support web 38, and is also stitched into the unitary structure 59 by means of the conventional stitching 55. This unitary structure is removably affixed to the rim portion 24 of outer drum 22 in overlying relation therewith by a conventional fastening means. In the preferred embodiment illustrated, Velcro™ hook and loop fastening material is used. More particularly, a loop 60 of the hook portion of the Velcro™ material is permanently affixed to the perimeter of an outer surface 58 of outer drum 22 by conventional means, such as adhesive or rivets (not shown). The mating loop 62 portion of the Velcro™ material is stitched to the coupling strap 56 by conventional stitching 63. When the coupling strap 56 is folded over the rim portion 24, so that the mating portions 60, 62 are brought into fastening contact with one another, a continuous fastening bond is thus formed between the entire perimeter of the unitary structure 59 and the entire perimeter of the outer surface 58 of outer drum 22. Accordingly, suspension of the kinetic energy absorptive member 34 and the anti-ricochet liner 46 into outer chamber 32 is accomplished. An adjustable tensioning belt 64 may be optionally fitted around the outer surface 58 of outer drum 22 in overlaying relation to the joint formed by the mating portions 60 and 62 of hook and loop fastening material. The tensioning belt 64 can then be tightened to further secure the unitary structure 59 to outer drum 22.

The ballistic containment device 20 has been tested using firearms of varying calibre. Testing was carried out at a muzzle-to-ballistic containment device distance of 15 feet (15') in order to obtain maximum projectile velocity, and additionally at a muzzle-to-ballistic containment device distance of 6 inches (6") to confirm that no ricochets resulted, which could not be contained by the ballistic containment device. Sample test parameters and specifications are set out below.

| SHOT # | DIST. | CALIBRE | AMMUNITION | LOCATION |
|---|---|---|---|---|
| #1 | 15' | 12 Ga. | 1 oz. Refiled Slug | Center |
| #2 | 15' | 12 Ga. | 1 oz. Refiled Slug | Side |
| #3 | 15' | 40 Cal. | 180 Gr. FMJ-TC | Center |
| #4 | 15' | 40 Cal. | 180 Gr. FMJ-TC | Side |
| #5 | 6" | 40 Cal. | 155 Gr. FMJ-TC | Side |
| #6 | 6" | 9 mm | 147 Gr. FMJ-TC | Side |
| #7 | 6" | 9 mm | 124 Gr. FMJ-TC | Center |
| #8 | 6" | 38 Cal. 4" Revl. | 158 Gr. + P SWC Lead | Center |
| #9 | 15' | 9 mm MP-5 | 124 Gr. FMJ-TC | Side |
| #10 | 6" | 9 mm MP-5 | 124 Gr. FMJ-TC | Center |

In all cases, the projectile rounds were contained within the ballistic containment device. It should be noted that during the testing, projectiles were directed, both at the center and at the sides of the ballistic containment device, and in each case all rounds were successfully contained. There were no ricochets back toward the testing operator. Furthermore, damage to the kinetic energy absorptive member 34 was limited to 20% for firing of projectiles from handguns, and 50% when a shotgun rifled slug was fired.

Figure 5:
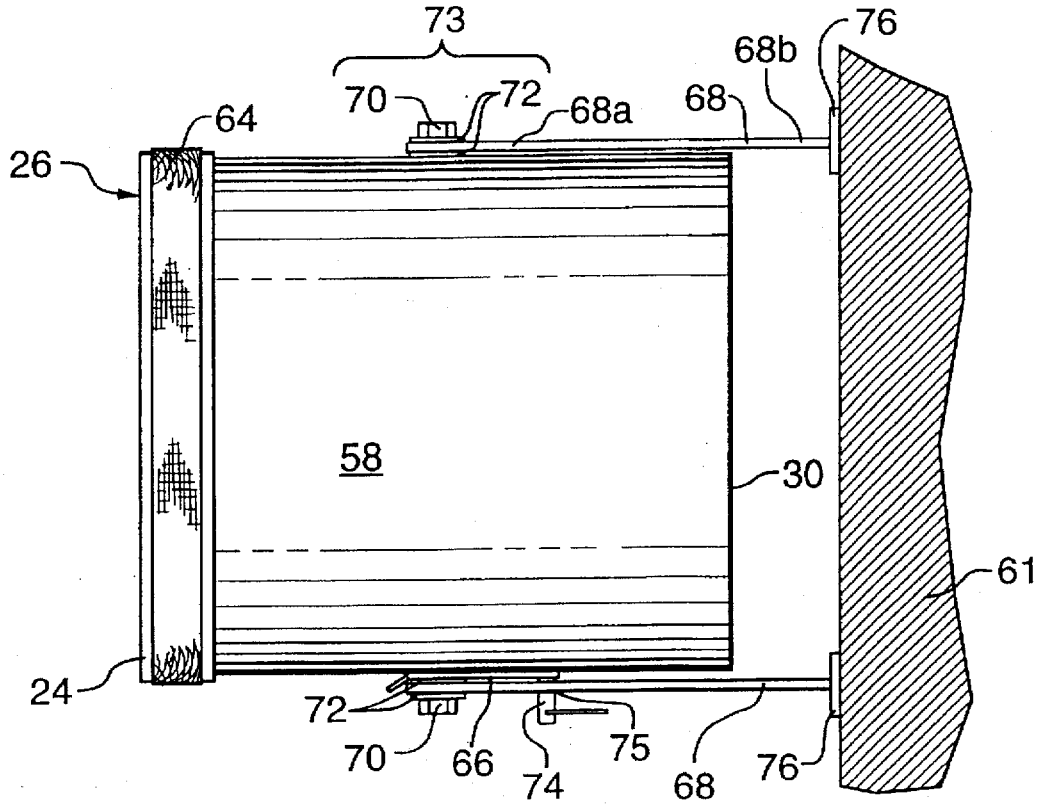
FIG. 5 of the drawings is a top plan view of the ballistic containment device of FIG. 1.
Figure 6:
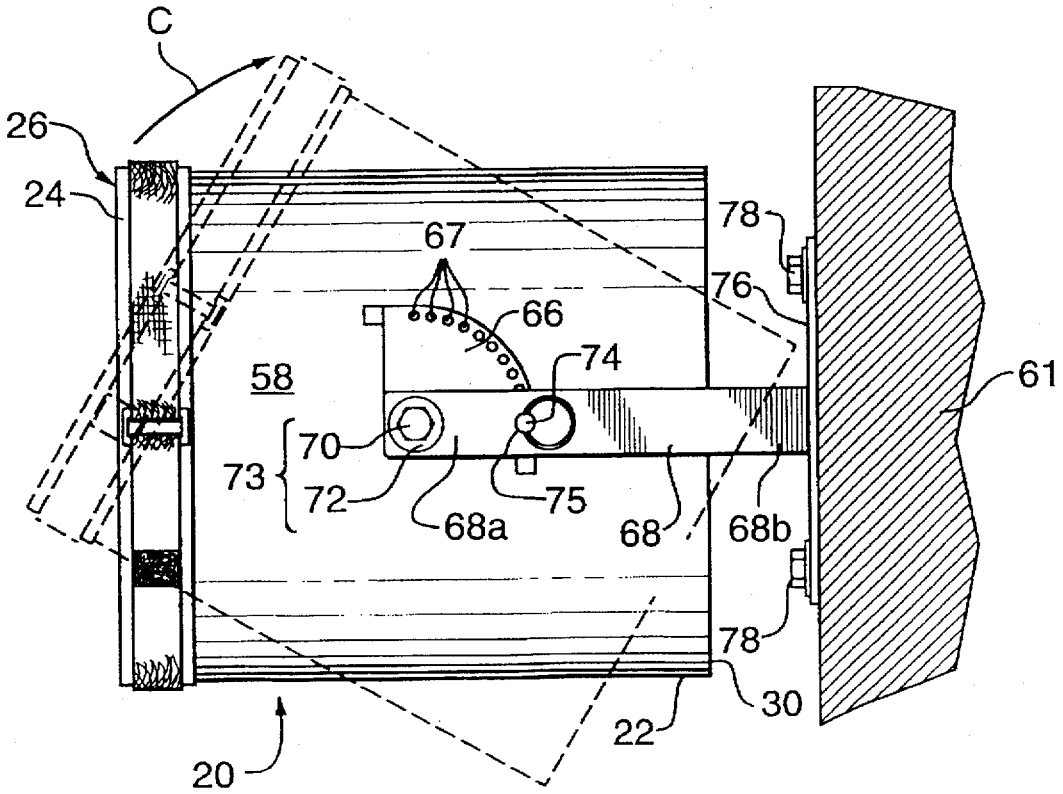
FIG. 6 is a side elevational view of the ballistic containment device of FIGS. 1–5 showing the adjustable tiltability of the device from a horizontal operative orientation (in solid outline) to the approximate tilt angle of FIG. 1 (in phantom outline)

Referring now to FIGS. 1, 5, and 6, two support arms 68, each have opposed first **68*a* and second 68*b* ends, pivotally mounted, one each, to each of two diametrically opposed sides of outer surface 58 of the substantially cylindrical outer drum 22. Each of the support arms 68 has, adjacent its first end 68*a*, an opening through which a mounting stud 73 passes, (to pivotally mount, as aforesaid, each of the support arms 68 to the outer drum 22). In the preferred embodiment illustrated, (as best seen in FIGS. 1, 5, and 6) each of the mounting studs 73 comprises an assembly of a bolt 70, two washers 72 and a nut (not shown), which nut screw threadingly engages the bolt within the outer drum 22 in adjustable frictional contact with the inner wall 28. A base plate 76 is permanently attached to the respective second end of each support arm 68. Such permanent attachment can be facilitated by spot welding, or any other conventional attachment means. The base plate 76 contains one our more openings to permit a conventional mounting bolt 78 to be employed to secure the ballistic containment device 20 to either a horizontal surface, such as a floor, or a vertical surface, such as the wall 61 illustrated in FIG. 1. Thus the ballistic containment device 20 is secured to a planar surface, and the outer drum 22 thereof can pivot about the longitudinal axis of the mounting studs 73**.

The ballistic containment device 20 is further adapted to permit the adjustable securement thereof for use at a desired tilt-angle. A tilt-angle calibration bracket 66 (see FIG. 1) is rigidly affixed to at least one of the two opposed sides of the cylindrical outer drum 22, on the outer surface 58 thereof, adjacent one of said pivot studs 73. Such affixation can be by rivets, screws, welding, or any other conventional fastening means. The tilt-angle calibration bracket 66 is, in the illustrated embodiment, substantially sector-shaped, although other shapes are permitted. The key factor is that the tilt-angle calibration bracket 66 must have a plurality of openings 67 radially arrayed about the longitudinal axis of the mounting stud 73. In the preferred embodiment illustrated, the tilt-angle calibration bracket 66 has an opening at a selected position therein to facilitate the through-passing of the mounting stud 73 and to thereby ensure proper radial arrangement of the openings 67.

The respective one of the support arms 68 adjacent to the tilt-angle calibration bracket 66 is also provided with a transversely oriented locking means receiving aperture 75. A locking means in the form of a locking pin 74 is removably insertable through both the locking means receiving aperture 75 of the respective support arm 68 and through a selected one of the openings 67 in tilt-angle calibration bracket 66 when the outer drum 22 is tilted so that aperture 75 and the selected one of the openings 67 are in register with one another. Thus, by employing locking pin 74 in cooperation with the receiving aperture 75 and the tilt-angle calibration bracket 66, the relative position of the ballistic containment device can be adjusted and locked so that the user can adopt a regulation safety stance when loading, unloading, or inspecting a firearm. In FIG. 6, arrow "C" illustrates the adjustment of tilt-angle from the horizontal orientation shown in solid line to the upwardly tilted orientation (of FIG. 1), as shown in phantom outline in FIG. 6.

In use, as illustrated in FIG. 1, the preferred embodiment of the present invention is mounted to wall 61 by bolts 78, thus securing base plates 76, 76 to the wall 61. The outer drum 22 is mounted to support arms 68 by means of the mounting studs 73. Locking pin 74 is employed in cooperation with the tilt-angle calibration bracket 66 and the receiving aperture 75 to maintain the outer drum 22 at a selected operational tilt-angle. An operator 77 intending to unload a handgun 79 directs the barrel of the handgun 79 into the open end 26 of the outer drum 22 toward the parabolic centre of the anti-ricochet safety layer 46, of which only the outer protective layer 52 is visible. In the event of an accidental discharge of the handgun 79, the projectile would be safely retained within the ballistic containment device 20.

In order to assemble a semi-rigid kinetic energy absorptive member 34 according to the invention, a plurality of petal-shaped panels **34*a* and 34*b* (See FIG. 4) are cut from sheets of the ballistic fabric, as previously described above, and a plurality of substantially circular panels 31 are also cut from the same fabric. A non-rigid adhesive material, as previously described, is applied to a selected number of the plurality of petal-shaped panels, preferably two. The selected number of panels are positioned on a waxed mold surface having a substantially parabolic shape (not shown) to form a layer of a substantially parabolic structure. The petal-shaped panels 34*a* and 34*b* overlap one another at their respective distal edges by at least about one inch (1"). In the preferred embodiment illustrated, two (2) petal-shaped panels 34*a* and 34*b* are overlapped to form each layer 34' of the semi-rigid kinetic energy absorptive member 34. This overlapping pattern can best be seen in FIG. 4 wherein the distal edges 35** of each layer can be seen to overlap (partly in phantom outline).

When each layer of petal-shaped panels has been positioned on the substantially parabolic structure, as described above, the non-rigid adhesive is applied to a substantially circular panel of ballistic fabric 31', and the panel is then applied to the tapered closed end 36 of the substantially parabolic structure (as shown in FIG. 4 in phantom outline). Each substantially circular panel 31' serves to anchor the petal-shaped panels of the underlying layer into position. The non-rigid adhesive is then applied to additional petal-shaped panels, which panels are then positioned in overlapping relation over the outer exposed surface of the substantially parabolic structure to form further layers 34' of the structure. In order to complete each layer 34', a further substantially circular panel 31'(to which non-rigid adhesive material has also been applied as aforementioned) is positioned at the tapered closed end 36 of the substantially parabolic structure. When the substantially parabolic structure has reached a desired thickness, it is released from the waxed mold surface and is secured about its circumferential open end with stitching 41, thus forming the completed kinetic energy absorptive member 34.

In the preferred embodiment described and illustrated above, the ballistic containment device 20 of the present invention is optimally designed for use with most firearms. It will be obvious to those skilled in the art that the invention could be used effectively in a wide range of ballistic containment applications, by adjusting the thickness of the kinetic energy absorptive member, and the number and thickness of ballistic fabric plies in the sub-layer of the anti-ricochet safety liner. Additionally, other materials having known anti-ballistic kinetic energy absorptive characteristics could be used to construct the kinetic energy absorptive member 34, the support web 38, and the sub-layer 54 of the anti-ricochet safety liner 46. For example a high performance polyethylene fibre (HPPE), characterized by a parallel orientation of molecules of greater than 95% and a high level of crystallinity (up to 85%), manufactured by DSN N.V. (Corporation) of the Netherlands, and sold under the trademark Dyneema™ could be substituted. Also, ballistic material made from a high strength synthetic fibre impregnated in partially cured resin, made available by Allied Signal Inc. under the registered trademark Spectra Shield® could be used.

Further, the anti-ricochet safety liner could optionally be formed as a thin plastic cone which would function in substantially the same manner as the anti-ricochet safety liner of the preferred embodiment illustrated.

Additionally, variations could be made in the manner of suspension of the kinetic energy absorptive member and the anti-ricochet safety liner into the containment chamber of the containment drum. Similarly, the means for mounting the ballistic containment device and for adjusting the tilt angle thereof could be routinely varied, for example, by employing a ball detent as the locking means rather than the locking pin 74. Also, the shape of the outer drum 22 can be varied.

Similarly, the optimal method of construction of the kinetic energy absorptive member 34 has been described; however, it would be obvious to those skilled in the art that the number and shape of petal-shaped panels per layer could be varied. Further, the non-rigid adhesive material could be applied to the exposed outer surface of the substantially parabolic structure prior to the application of further layers of petal-shaped panels, rather than the application of the non-rigid adhesive to the panels themselves. Thus, it will be apparent that the scope of the present invention is limited only by the claims set out hereinbelow.

We claim:

1. A ballistic containment device for use in inspecting, loading and unloading firearms, comprising:

an outer drum having a rim portion defining an open end;

an inner wall surface axially extending from said rim portion to a closed end, said rim portion, said inner wall surface and said closed end together defining an outer chamber; and, a semi-rigid kinetic energy absorptive member suspended into said outer chamber from said rim portion by means of a support web constructed of a plurality of overlapping straps of fabric woven from long chain synthetic polyamide fibre bonded to said kinetic energy absorptive member by means of a non-rigid adhesive material, said kinetic energy absorptive member being constructed from a plurality of layers of fabric woven from long chain synthetic polyamide fibre, said layers being bonded one to the other by means of said non-rigid adhesive material.

2. A ballistic containment device according to claim 1, wherein the plurality of overlapping straps are overlain to form a support web of substantially parabolic cross section, the free ends of each of said straps outwardly extending from the parabolic point of origin of said web to contact said rim portion in attached overlying relation thereto.

3. A ballistic containment device according to claim 2, wherein the kinetic energy absorptive member is of substantially parabolic cross section, having its tapered closed end suspended out of contact with the closed end of said outer drum.

4. A ballistic containment device according to claim 1, further comprising an anti-ricochet safety liner of substantially parabolic cross section, suspended into said outer chamber from said rim portion and in layered relation out of contact with and above said kinetic energy absorptive member.

5. A ballistic containment device according to claim 4, wherein the anti-ricochet safety liner has a tapered closed end at the parabolic point of origin thereof, and a distal perimeter portion attached in overlying relation to said rim portion.

6. A ballistic containment device according to claim 5, wherein the anti-ricochet safety liner further comprises an outer protective layer of strong flexible textile material, and a sub-layer formed from fabric woven from long chain synthetic polyamide fibre underlying said outer protective layer, both said outer protective layer and said sub-layer being attached to one another adjacent their respective distal perimeter portions by stitching.

7. A ballistic containment device according to claim 6, wherein the free ends of said support web and the distal perimeter portion of said anti-ricochet liner are stitched together.

8. A ballistic containment device according to claim 7, wherein the stitched free ends of said support web and the distal perimeter portion of said anti-ricochet liner are circumscribed by a reinforcing strap and secured to each other by stitching to form a unitary structure, which unitary structure is removably affixed to the rim portion of the outer drum, in overlying relation therewith by fastening means.

9. A ballistic containment device according to claim 8, wherein said fastening means is hook and loop fastening material.

10. A ballistic containment device according to claim 9, wherein the hook portion of said hook and loop fastening material is permanently affixed to the perimeter of an outer wall surface of said outer drum adjacent the open end of said drum, and the loop portion of said material is stitched to said reinforcing strap.

11. A ballistic containment device according to claim 10, further comprising a tensioning belt positioned in tensioning overlying relation to the reinforcing strap of said unitary structure.

12. A ballistic containment device according to claim 10, wherein the outer protective layer of strong flexible textile material is constructed from a rough woven nylon fabric.

13. A ballistic containment device according to claim 6, wherein the kinetic energy absorptive member, the support web and the sub-layer of the anti-ricochet safety liner are all constructed from a kinetic energy absorbing fabric of woven long chain synthetic polyamide fibres.

14. A ballistic containment device according to claim 1, wherein said outer drum is constructed from mild steel.

15. A ballistic containment device according to claim 1, wherein the non-rigid adhesive material is a butyl rubber-based contact cement.

16. A ballistic containment device according to claim 1, wherein said outer drum is of substantially circular cross section.

17. A ballistic containment device according to claim 16, further comprising:

two mounting studs positioned one each in diametrically opposed relation on an outer surface of said outer drum;

two support arms each having opposed first and second ends and being pivotally mounted one each adjacent their respective first ends on said mounting studs to permit tilting motion of said outer drum relative to said support arms;

a base plate rigidly connected to each of said support arms adjacent the respective second ends of said support arms, said base plate having one or more mounting openings therethrough to permit mounting of said base plate to a planar mounting surface;

a tilt-angle calibration bracket, mounted to the outer surface of said outer drum adjacent at least one of said mounting studs, said tilt-angle calibration bracket having a plurality of openings radially arrayed about the longitudinal axis of said at least one of said pivot studs;

the respective one of said support arms adjacent the tilt-angle calibration bracket having a transverse locking means receiving aperture therethrough;

a locking means removably insertable through said locking means receiving aperture in said support arm and through a selected one of said plurality of openings in said tilt-angle calibration bracket, when said aperture and said opening are in register with one another, to secure the outer drum at a selected tilt angle.

18. A ballistic containment device according to claim 1, further comprising a means for mounting the ballistic containment device to a horizontal surface.

19. A ballistic containment device according to claim 1, further comprising a means for mounting the ballistic containment device to a vertical surface.

20. A ballistic containment device according to claim 1, further comprising a means for adjustably securing the ballistic containment device at a selected tilt-angle.

21. A ballistic containment device for use in inspecting, loading and unloading firearms, comprising:

a outer drum, substantially cylindrical in cross section, having a rim portion defining an open end;

an inner wall surface axially extending from said rim portion to a closed end, said rim portion, said inner wall surface and said closed end together defining an outer chamber;

a semi-rigid kinetic energy absorptive member constructed from a plurality of layers of fabric woven from long chain synthetic polyamide fibre, said layers being bonded one to the other by means of a non-rigid adhesive material;

a support web, constructed of a plurality of overlapping straps of fabric woven from long chain synthetic polyamide fibre, bonded to said kinetic energy absorptive member by means of said non-rigid adhesive material;

an anti-ricochet safety liner, of substantially parabolic cross section, suspended into said outer chamber from said rim portion, said liner having an outer protective layer of rough woven nylon fabric, and a sub-layer formed from fabric woven from long chain synthetic polyamide fibre, attached to said outer protective layer by stitching;

a reinforcing strap secured to said support web and said anti-ricochet liner by stitching to form a unitary structure, which unitary structure is removably affixed to the rim portion of the outer drum, in overlying relation therewith by fastening means;

a tensioning belt positioned in tensioning overlying relation to said reinforcing strap to additionally secure said unitary structure to the rim portion of the outer drum;

two mounting studs positioned one each in diametrically opposed relation on an outer surface of said outer drum;

two support arms each having opposed first and second ends and being pivotally mounted one each adjacent their respective first ends on said mounting studs to permit tilting motion of said outer drum relative to said support arms;

a base plate rigidly connected to each of said support arms adjacent the respective second ends of said support arms, said base plate having one or more mounting openings therethrough to permit mounting of said base plate to a planar mounting surface;

a tilt-angle calibration bracket, mounted to the outer surface of said outer drum adjacent at least one of said mounting studs, said tilt-angle calibration bracket having a plurality of openings radially arrayed about the longitudinal axis of said at least one of said pivot studs;

the respective one of said support arms adjacent the tilt-angle calibration bracket having a transverse locking means receiving aperture therethrough;

a locking means removably insertable through said locking means receiving aperture in said support arm and through a selected one of said plurality of openings in said tilt-angle calibration bracket, when said aperture and said opening are in register with one another, to secure the outer drum at a selected tilt angle.

* * * * *